US006267257B1

(12) United States Patent
DeBruyn

(10) Patent No.: US 6,267,257 B1
(45) Date of Patent: Jul. 31, 2001

(54) DOOR MOUNTED HANGING DEVICE

(76) Inventor: Benjamin DeBruyn, 12801 Fair Oaks Blvd., #214, Citrus Heights, CA (US) 95610

( * ) Notice: Subject to any disclaimer, the term of this patent is extended or adjusted under 35 U.S.C. 154(b) by 0 days.

(21) Appl. No.: 09/416,683

(22) Filed: Oct. 12, 1999

(51) Int. Cl.[7] ..... A47F 5/00

(52) U.S. Cl. ..... 211/119.004; 211/106; 248/214

(58) Field of Search ..... 211/106, 106.01, 211/119.004, 87.01, 119; 248/214, 215, 302, 303; D6/513, 411

(56) References Cited

U.S. PATENT DOCUMENTS

| | | | | |
|---|---|---|---|---|
| 194,707 | * | 8/1877 | Merrill . | |
| 345,020 | * | 7/1886 | Barney . | |
| D. 345,096 | * | 3/1994 | Shapiro . | |
| D. 405,153 | * | 2/1999 | Henry . | |
| 776,810 | * | 12/1904 | Smalley . | |
| 862,769 | * | 8/1907 | Taylor . | |
| 2,070,408 | * | 2/1937 | Leidgen | 211/96 |
| 2,150,826 | * | 3/1939 | Gill | 248/215 |
| 2,447,128 | * | 8/1948 | Logan . | |
| 2,459,909 | * | 1/1949 | Alofs . | |
| 2,531,151 | * | 11/1950 | Patt | 211/106 |
| 3,536,287 | * | 10/1970 | Kramer . | |
| 3,598,248 | * | 8/1971 | Black | 211/106 |
| 3,896,937 | | 7/1975 | Christian | 211/86 |
| 3,907,118 | | 9/1975 | Pelavin | 211/113 |
| 4,694,503 | | 9/1987 | Hydorn | 383/12 |
| 5,515,981 | | 5/1996 | Gregory et al. | 211/113 |
| 5,553,823 | | 9/1996 | Protz, Jr. | 248/304 |
| 6,052,918 | * | 4/2000 | Oletzke | 211/119.004 |

* cited by examiner

*Primary Examiner*—Robert W. Gibson, Jr.
(74) *Attorney, Agent, or Firm*—Goldstein Law Offices P.C.

(57) ABSTRACT

A door mounted hanging device including a door support adapted for coupling with a top edge of a door. The door support includes a V-shaped member positioned on the top edge of the door. The V-shaped member includes a pair of angularly disposed segments converging to a point at a first side of the top edge of the door. Free ends of the segments each have a downwardly extending portion secured thereto and positioned at a second side of the top edge of the door and extending downwardly along a back surface of the door. A hanger support is secured to the door support.

2 Claims, 2 Drawing Sheets

FIG 1
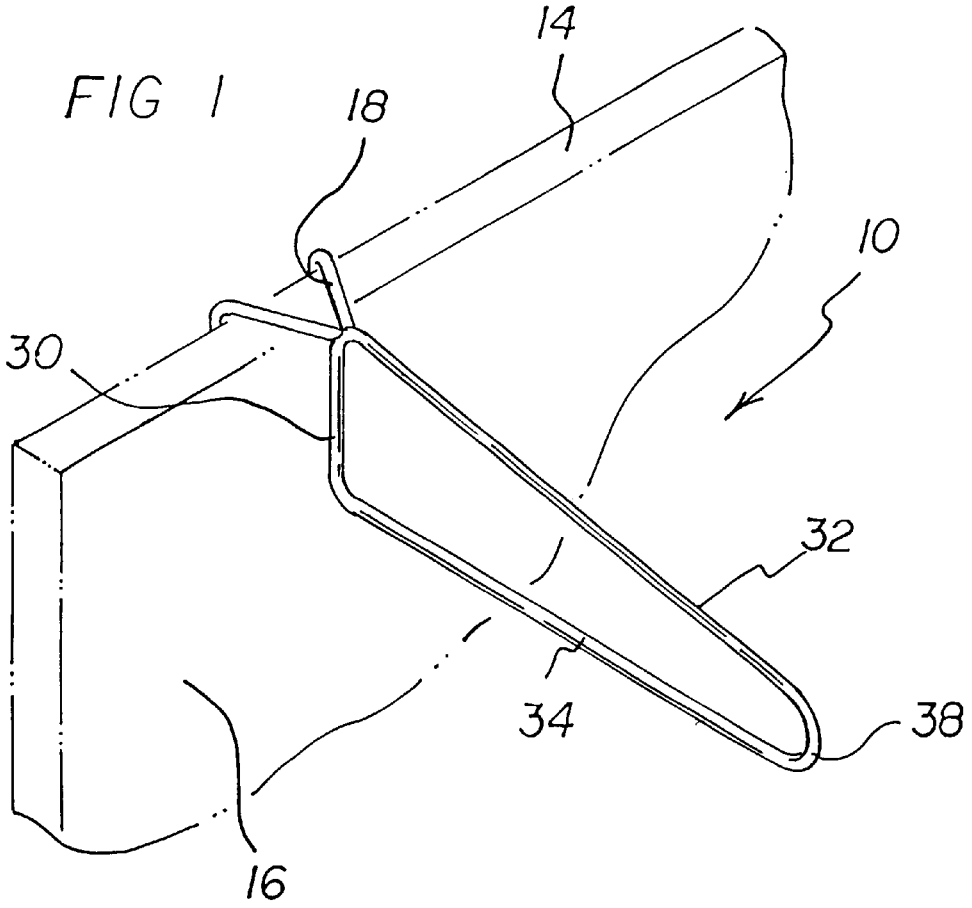
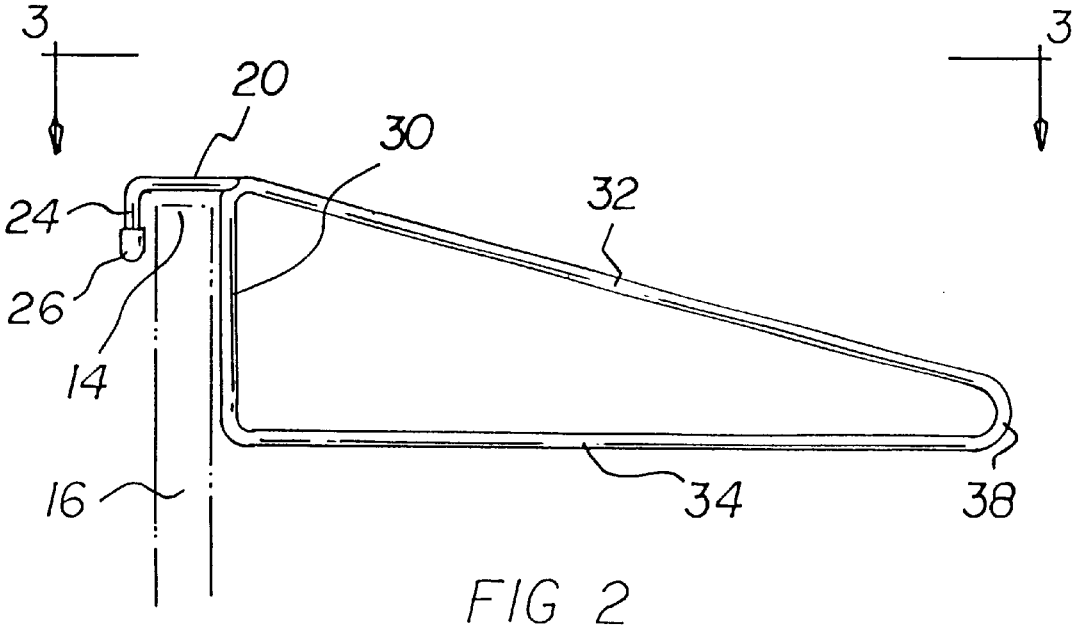
FIG 2

DOOR MOUNTED HANGING DEVICE

BACKGROUND OF THE INVENTION

The present invention relates to a door mounted hanging device and more particularly pertains to supporting a multiple of clothing hangers from a door.

Conventional type hangers are generally adapted for suspending an item of clothing from a rail or pole that extends between a pair of opposed walls or other structure. These hangers are provided with a hooked upper end for removably mounting on the rail or pole. Connected with the hooked upper end is usually a triangular shaped body member on which the item of clothing can be draped.

Unfortunately, these conventional hangers are not adapted to suspend an item of clothing from a door, without manipulating the hooked upper end in some manner. Even if the hanger is manipulated to fit over the top of the door, the result is often unwanted damage to the door itself.

What is needed is a device that can safely secure to a top of a door for supporting a plurality of hangers thereon whereby the hangers can support clothing items thereon.

The present invention attempts to solve the abovementioned problem by providing a device that can removably secure to a top of a door for receiving a number of hangers thereon.

The use of hanging devices is known in the prior art. More specifically, hanging devices heretofore devised and utilized for the purpose of suspending clothes hangers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,515,981 to Gregory discloses a device with a hook for organizing and suspending a number of clothing hangers. U.S. Pat. No. 3,896,937 to Christian discloses a hanger for holding a number of garments and appears supported by an open draw. U.S. Pat. No. 3,907,118 to Palavin discloses a hanger for supporting garments from a vertical surface using a mounting bracket and S-hook assembly. U.S. Pat. No. 5,553,823 to Protz, Jr. discloses a support assembly for suspending a wreath from a door mountable hanger. U.S. Pat. No. 4,694,503 to Hyudorn discloses means for hanging a laundry bag on a door.

While these devices fulfill their respective, particular objective and requirements, the aforementioned patents do not describe a door mounted hanging device for supporting a multiple of clothing hangers from a door.

In this respect, the door mounted hanging device according to the present invention substantially departs from the conventional concepts and designs of the prior art, and in doing so provides an apparatus primarily developed for the purpose of supporting a multiple of clothing hangers from a door.

Therefore, it can be appreciated that there exists a continuing need for a new and improved door mounted hanging device which can be used for supporting a multiple of clothing hangers from a door. In this regard, the present invention substantially fulfills this need.

SUMMARY OF THE INVENTION

In the view of the foregoing disadvantages inherent in the known types of hanging devices now present in the prior art, the present invention provides an improved door mounted hanging device. As such, the general purpose of the present invention, which will be described subsequently in greater detail, is to provide a new and improved door mounted hanging device and method which has all the advantages of the prior art and none of the disadvantages.

To attain this, the present invention essentially comprises a door support adapted for coupling with a top edge of a door. The door support includes a V-shaped member positioned on the top edge of the door. The V-shaped member includes a pair of angularly disposed segments converging to a point at a first side of the top edge of the door. Free ends of the segments each have a downwardly extending portion secured thereto and positioned at a second side of the top edge of the door and extending downwardly along a back surface of the door. Free ends of the downwardly extending portions have a protective rubber knob disposed thereon. A hanger support is secured to the door support. The hanger support has a generally triangular configuration defined by a small vertical segment secured to and extending downwardly from the point of the pair of angularly disposed segments. A top end of the small vertical segment has an elongated angular segment extending outwardly therefrom. A lower end of the small vertical segment has an elongated horizontal segment extending outwardly therefrom. Outer ends of the elongated angular segment and the elongated horizontal segment are joined by an arced segment.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door mounted hanging device which has all the advantages of the prior art hanging devices and none of the disadvantages.

It is another object of the present invention to provide a new and improved door mounted hanging device which may be easily and efficiently manufactured and marketed.

It is a further object of the present invention to provide a new and improved door mounted hanging device which is of durable and reliable construction.

An even further object of the present invention is to provide a new and improved door mounted hanging device which is susceptible of a low cost of manufacture with regard to both materials and labor, and which accordingly is then susceptible of low prices of sale to the consuming public, thereby making such a door mounted hanging device economically available to the buying public.

Even still another object of the present invention is to provide a new and improved door mounted hanging device for supporting a multiple of clothing hangers from a door.

Lastly, it is an object of the present invention to provide a new and improved door mounted hanging device including a door support adapted for coupling with a top edge of a door. The door support includes a V-shaped member positioned on the top edge of the door. The V-shaped member includes a pair of angularly disposed segments converging to a point at a first side of the top edge of the door. Free ends of the segments each have a downwardly extending portion secured thereto and positioned at a second side of the top edge of the door and extending downwardly along a back surface of the door. A hanger support is secured to the door support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the door mounted hanging device constructed in accordance with the principles of the present invention.

FIG. 2 is a side view of the present invention illustrated in place on a door.

The same reference numerals refer to the same parts through the various figures.

DESCRIPTION OF THE PREFERRED EMBODIMENT

Figure 3:
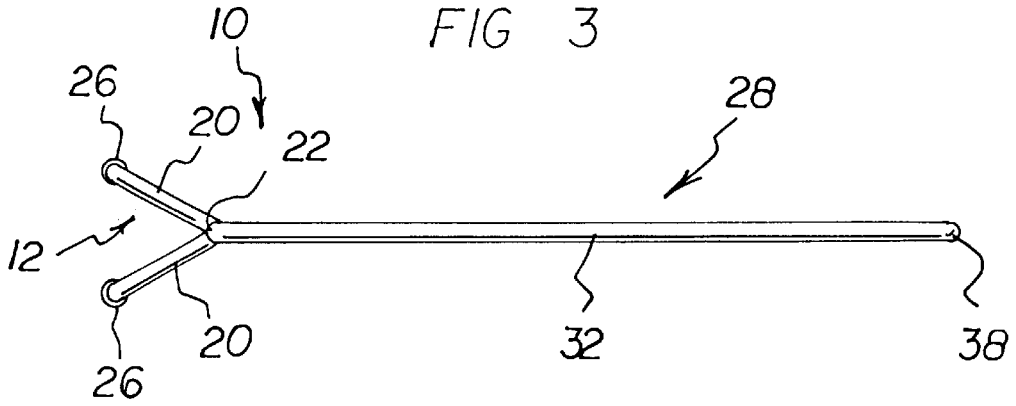
FIG. 3 is a top plan view of the present invention as taken along line 3—3 of FIG. 2.
Figure 4:
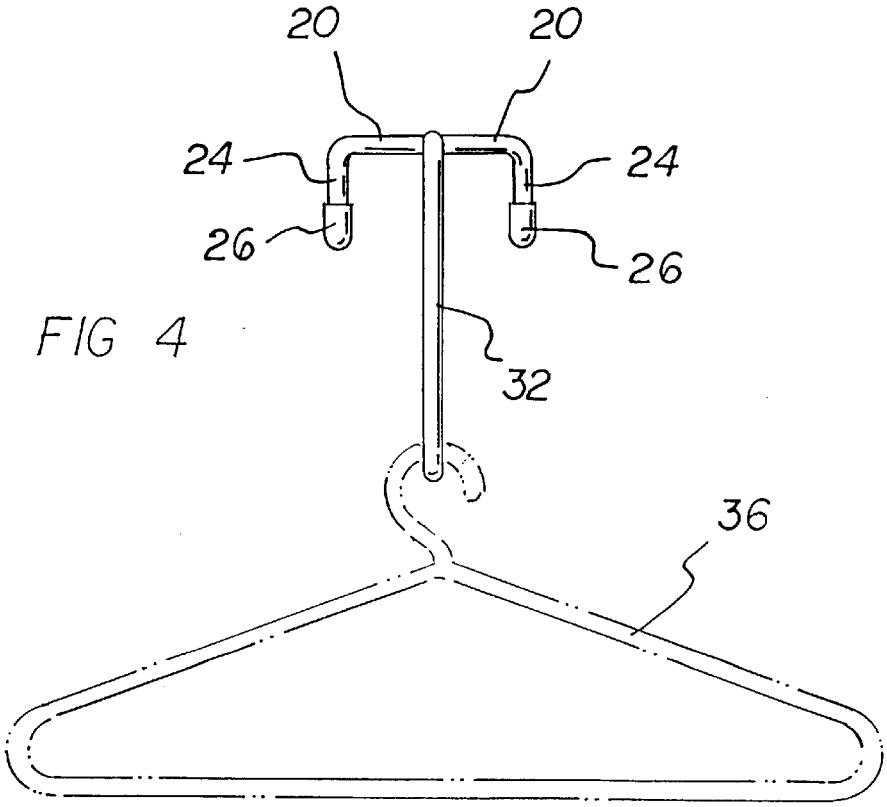
FIG. 4 is a front view of the present invention illustrated in use.

With reference now to the drawings, and in particular, to FIGS. 1 through 4 thereof, the preferred embodiment of the new and improved door mounted hanging device embodying the principles and concepts of the present invention and generally designated by the reference number 10 will be described.

Specifically, it will be noted in the various Figures that the device relates to a door mounted hanging device for supporting a multiple of clothing hangers from a door. In its broadest context, the device consists of a door support and a hanger support. Such components are individually configured and correlated with respect to each other so as to attain the desired objective.

The door support 12 is adapted for coupling with a top edge 14 of a door 16. The door support 12 includes a V-shaped member 18 positioned on the top edge 14 of the door 16. The V-shaped member 18 includes a pair of angularly disposed segments 20 converging to a point 22 at a first side of the top edge 14 of the door 16. Free ends of the segments 20 each have a downwardly extending portion 24 secured thereto and positioned at a second side of the top edge 14 of the door 16 and extending downwardly along a back surface of the door 16. Free ends of the downwardly extending portions 24 have a protective rubber knob 26 disposed thereon. The rubber knobs 26 will prevent any damage to the door 16 from scratching.

The hanger support 28 is secured to the door support 12. The hanger support 28 has a generally triangular configuration defined by a small vertical segment 30 secured to and extending downwardly from the point 22 of the pair of angularly disposed segments 20. A top end of the small vertical segment 30 has an elongated angular segment 32 extending outwardly therefrom. A lower end of the small vertical segment 30 has an elongated horizontal segment 34 extending outwardly therefrom. The horizontal segment 34 will support a clothes hanger 36 thereon. Note FIG. 4. Outer ends of the elongated angular segment 32 and the elongated horizontal segment 34 are joined by an arced segment 38.

In use, the door support 12 is placed over the top edge 14 of the door 16 so that hanger support 28 extends outwardly from the door 16 so that the horizontal segment 34 is perpendicular to the door 16 to support clothes hangers 36 thereon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A door mounted hanging device for supporting a multiple of clothing hangers from a door comprising, in combination:

a door support adapted for coupling with a top edge of a door, the door support including a V-shaped member positioned on the top edge of the door, the V-shaped member including a pair of angularly disposed segments converging to a point at a first side of the top edge of the door, free ends of the segments each having a downwardly extending portion secured thereto and positioned at a second side of the top edge of the door and extending downwardly along a back surface of the door, free ends of the downwardly extending portions having a protective rubber knob disposed thereon;

a hanger support secured to the door support, the hanger support having a generally triangular configuration defined by a small vertical segment secured to and extending downwardly from the point of the pair of angularly disposed segments, a top end of the small vertical segment having an elongated angular segment extending outwardly therefrom, a lower end of the small vertical segment having an elongated horizontal segment extending outwardly therefrom, outer ends of the elongated angular segment and the elongated horizontal segment being joined by an arced segment.

2. A door mounted hanging device for supporting a multiple of clothing hangers from a door comprising, in combination:

a door support adapted for coupling with a top edge of a door, the door support including a V-shaped member positioned on the top edge of the door, the V-shaped member including a pair of angularly disposed segments converging to a point at a first side of the top edge of the door, free ends of the segments each having a downwardly extending portion secured thereto and positioned at a second side of the top edge of the door and extending downwardly along a back surface of the door wherein the free ends of the downwardly extending portions of the door support each have a protective rubber knob disposed thereon.

a hanger support secured to the door support.

* * * * *